US010794014B2

(12) United States Patent
Villwock et al.

(10) Patent No.: US 10,794,014 B2
(45) Date of Patent: Oct. 6, 2020

(54) SOIL COMPACTOR

(71) Applicant: Hamm AG, Tirschenreuth (DE)

(72) Inventors: Sebastian Villwock, Pechbrunn (DE); Werner Völkel, Neustadt (DE)

(73) Assignee: HAMM AG, Tirschenreuth (DE)

( * ) Notice: Subject to any disclaimer, the term of this patent is extended or adjusted under 35 U.S.C. 154(b) by 48 days.

(21) Appl. No.: 16/009,448

(22) Filed: Jun. 15, 2018

(65) Prior Publication Data

US 2018/0291568 A1 Oct. 11, 2018

Related U.S. Application Data

(62) Division of application No. 15/211,428, filed on Jul. 15, 2016, now Pat. No. 10,024,003.

(30) Foreign Application Priority Data

Aug. 5, 2015 (DE) ..... 10 2015 112 847

(51) Int. Cl.
*E01C 19/38* (2006.01)
*E01C 19/28* (2006.01)

(52) U.S. Cl.
CPC ..... *E01C 19/286* (2013.01); *E01C 19/282* (2013.01)

(58) Field of Classification Search
CPC ..... E01C 19/282
USPC ..... 404/113, 117
See application file for complete search history.

(56) References Cited

U.S. PATENT DOCUMENTS 3,543,656 A * 12/1970 Roettger ..... E01C 19/282 404/117
3,814,531 A * 6/1974 Carnahan ..... B62D 53/02 404/117
6,402,424 B2 * 6/2002 Mitsui ..... E01C 19/286 404/117
6,698,974 B2 * 3/2004 Codina ..... B06B 1/04 404/117
6,829,986 B2 * 12/2004 Richter ..... B06B 1/161 100/155 R
7,213,479 B2 * 5/2007 Mitsui ..... E01C 19/286 74/61
8,206,061 B1 * 6/2012 Hansen ..... E01C 19/286 404/128
8,393,825 B2 * 3/2013 Marsolek ..... E01C 19/286 404/117
8,439,598 B2 5/2013 Norton
9,039,324 B2 * 5/2015 Ackermann ..... E01C 19/282 404/117
9,207,157 B2 * 12/2015 Frelich ..... G01P 3/00
9,334,613 B2 * 5/2016 Erdmann ..... E01C 19/283
(Continued)

FOREIGN PATENT DOCUMENTS

DE 10 2011 109 663 2/2013
FR 2 748 500 11/1997
(Continued)

*Primary Examiner* — Thomas B Will
*Assistant Examiner* — Katherine J Chu
(74) *Attorney, Agent, or Firm* — Rankin, Hill & Clark LLP

(57) ABSTRACT

A soil compactor includes at least one compactor roller, which is free to rotate about an axis of rotation of the roller, with a plurality of roller segments, which follow one another along the direction of the axis of rotation of the roller. In each case, at least one electromotive drive for producing an oscillating torque is assigned to each roller segment.

6 Claims, 2 Drawing Sheets

(56) References Cited

Figure 1:
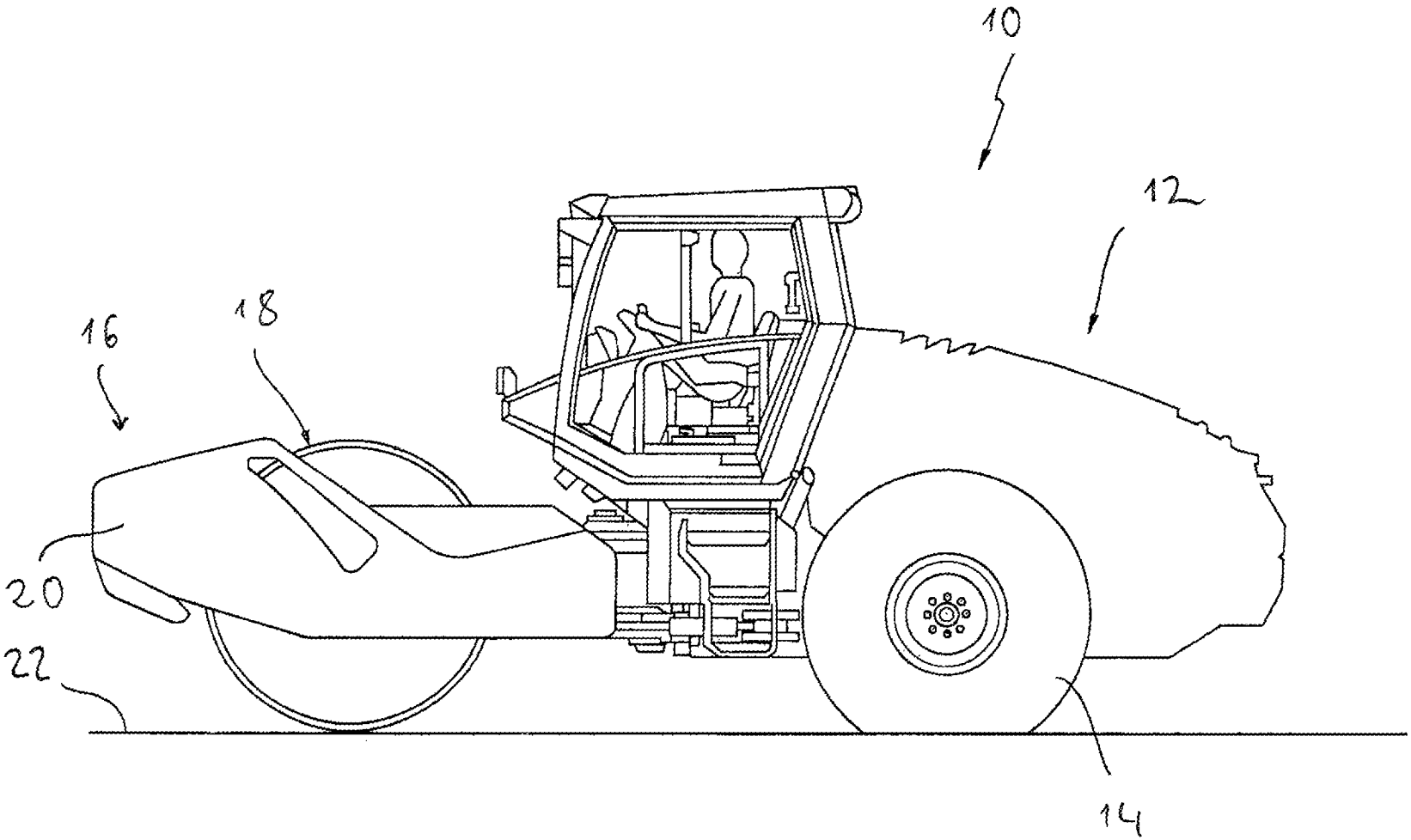

U.S. PATENT DOCUMENTS 10,265,730 B2 * 4/2019 Johnsson ..... B06B 1/161
2001/0048221 A1 * 12/2001 Mitsui ..... E01C 19/286 280/801.1
2003/0108389 A1 * 6/2003 Codina ..... B06B 1/04 404/117
2004/0009039 A1 * 1/2004 Corcoran ..... E01C 19/286 404/117
2004/0028472 A1 * 2/2004 Richter ..... B06B 1/161 404/117
2006/0034659 A1 * 2/2006 Magee ..... E01C 19/286 404/117
2009/0252554 A1 10/2009 Lura
2012/0301221 A1 * 11/2012 Ackermann ..... E01C 19/282 404/75
2014/0341650 A1 * 11/2014 Villwock ..... E02D 3/026 404/117
2015/0152606 A1 * 6/2015 Erdmann ..... E01C 19/283 404/117
2015/0191880 A1 * 7/2015 Oetken ..... E01C 19/282 404/72
2015/0308057 A1 * 10/2015 Marsolek ..... E01C 19/28 404/117
2016/0168806 A1 * 6/2016 Corcoran ..... E01C 19/288 701/50
2017/0016184 A1 * 1/2017 Oetken ..... B06B 1/16
2017/0121917 A1 * 5/2017 Frelich ..... E01C 19/26
2017/0284036 A1 * 10/2017 Rio ..... E01C 19/288

FOREIGN PATENT DOCUMENTS

JP 58-138803 8/1983
JP 2004514811 5/2004
JP 2006 336342 12/2006
JP 2006336342 12/2006
WO 2011/064367 6/2011
WO 2013/020857 2/2013

* cited by examiner

SOIL COMPACTOR

The present invention relates to a soil compactor, comprising at least one compactor roller, which is free to rotate about an axis of rotation of the roller, with a plurality of roller segments, which follow one another along the direction of the axis of rotation of the roller.

Such a soil compactor is known from WO 2011/064 367 A2. This soil compactor has a compactor roller, which is divided into two roller segments, which follow one another along the direction of the axis of rotation of the roller. A device for producing an oscillating torque, which is to be transferred to the compactor roller or to both roller segments of the latter, comprises, in each of the two roller segments, unbalance masses which are disposed eccentrically with respect to the axis of rotation of the roller and which are free to rotate about axes of rotation, which are eccentric with respect to the axis of rotation of the roller. These masses can be driven over belt drives, which are disposed in the two roller segments, by drive shafts, which are concentric with the axis of rotation of the roller.

In order to avoid unbalance masses getting out of phase in the event of a relative rotation between the two roller segments, the driveshafts, disposed in the roller segments concentrically with the axis of rotation of the roller, are coupled to one another, in the area adjoining the two roller segments, over a planetary transmission. This coupling ensures that the two roller segments oscillate synchronously with one another.

From DE 10 2011 109663 A1, a soil compactor is known, the compactor roller of which is formed with a single roller segment and can be driven by an electromotive drive to rotate about the axis of rotation of the roller. On the one hand, the electromotive drive can generate a drive torque produced for advancing the soil compactor in a working direction. Further, the electromotive drive can generate an oscillating torque for producing an oscillating movement, that is a back-and-forth rotational movement of the compactor roller about its axis of rotation, having a comparatively small deflection amplitude, in order to achieve an improved compacting result by the oscillating movement in this way produced and superimposed to the substantially uniform rotation during the driving operation.

It is an object of the present invention to improve a generic soil compactor in such a manner, that, while keeping the design simple, a synchronous oscillation of several roller segments can be ensured.

In accordance with the invention, this objective is accomplished by a soil compactor, comprising at least one compactor roller, which is free to rotate about an axis of rotation of the roller, with a plurality of roller segments, which follow one another along the direction of the axis of rotation of the roller.

Moreover, according to the invention, in each case at least one electromotive drive for producing an oscillating torque is assigned to each roller segment.

Since an independently energizable and activitable electromotive drive is assigned to each roller segment of the inventively constructed soil compactor, the oscillating torque, required for each roller segment to produce an oscillating movement, can be produced in such a manner that it is optimally matched with respect to its phase and amplitude to the respective rotational or angular position of this roller segment.

Accordingly, merely by activating the electromotive drives of the roller segments without mechanically linking roller segments to one another, a synchronous or in-phase oscillation of these can be attained, even if, for example, when passing through curves with comparatively small radii, a clearly different rotational speed of different roller segments is required or occurs.

In accordance with a particularly advantageous aspect of the present invention, it is proposed to configure at least one and preferably each electromotive drive as an external rotor motor with a stator and a rotor, surrounding the stator and coupled with the assigned roller segment for a joint rotation about the axis of rotation of the roller. Configuring the electromotive drives as external rotor motors leads to a compact construction, which can be integrated easily into a respective roller segment and is particularly advantageous, if more than two roller segments are provided and, particularly since a roller segment, not positioned in a longitudinal end region of the compactor roller, is not readily accessible in the axial direction.

For supporting or bearing the roller segments on the compactor frame, it is proposed to provide a roller axle, which extends along the axis of rotation of the roller and cannot be rotated about the axis of rotation of the roller, on a compactor frame, the roller segments being supported so that they can rotate about the axle of the roller. The stator of at least one and preferably of each external rotor motor may then be supported on this roller axle.

A further advantage of designing the electromotive drives as external rotor motors, that is, as motors with a stator, which is positioned radially inside and carried on the roller axle, is the easy accessibility for the different supply lines. For example, electrical supply lines and/or cooling medium supply lines, for cooling the electromotive drives, for at least one and preferably of each stator may be provided at the roller axle, preferably in the interior of the roller axle.

According to a further aspect, a defined, stable positioning of the roller segments with respect to one another on the one hand and also with respect to the axis of rotation of the roller on the other, can be achieved owing to the fact that at least one and preferably each roller segment is rotatably supported on the roller axle by means of at least one roller bearing.

Since sufficient space is available in the interior of the compactor roller or of the roller segments thereof, it is proposed that, for at least one and preferably each roller segment, at least one assigned electromotive drive shall be disposed in the interior of a roller segment, which is enclosed by a casing of this roller segment. It should be pointed out that, because of the fact that the oscillating torque of the inventive soil compactor is also generated by the electromotive drive and not by unbalance masses rotating in the interior of the roller segments, space does not have to be made available for such additional, rotating, unbalance masses.

In accordance with a further, particularly advantageous aspect, it is proposed to provide, for at least one and preferably each roller segment, at least one assigned electromotive drive for producing a drive torque. In the case of such an embodiment, the electromotive drive fulfills not only the functionality of producing the oscillating torque, but additionally also the functionality of producing the drive torque. Accordingly, it is not necessary to provide an extra drive assembly for generating the propulsion torque.

Figure 2:
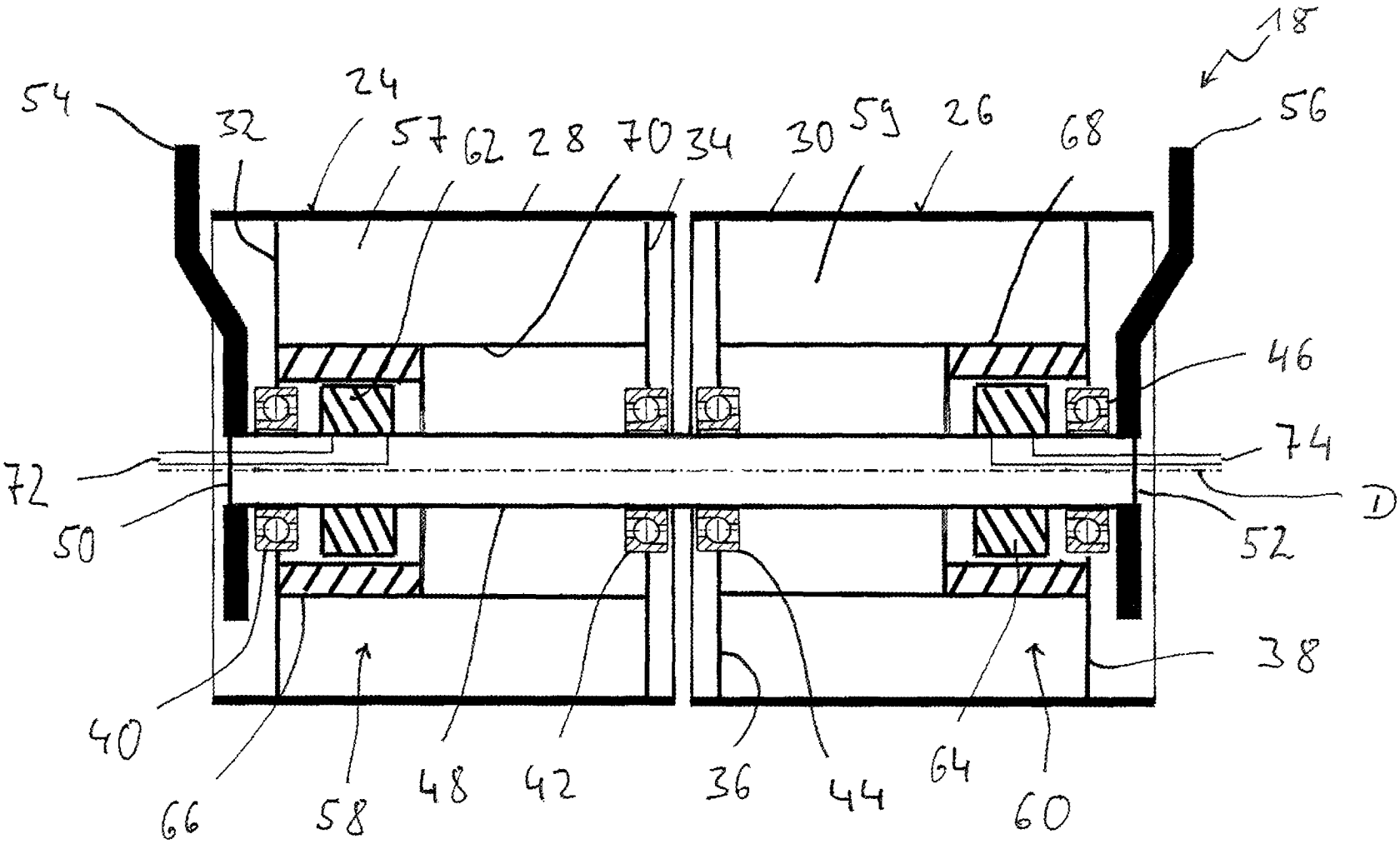

In the following, the present invention will be described in detail with reference to the enclosed Figures. In the drawing, FIG. 1 shows a soil compactor with a compacting roller;

FIG. 2 is a longitudinal section view of the compactor roller of the soil compactor of FIG. 1.

In FIG. 1, a self-propelled soil compactor as a whole is designated by 10. The soil compactor 10 comprises a drive assembly at a rear section 12, which may be designed, for example, to drive the wheels 14 at the rear section 12. A front section 16, which is hinged to the rear section 12, comprises a compactor roller 18, which is free to rotate at a compactor frame 20 of the front section 16 or of the soil compactor 10 about an axis of rotation D, which is orthogonal to the drawing plane of FIG. 1. By moving the soil compactor 10 on the ground 22 to be compacted, compaction of the ground 22 is effected by the load exerted by the compactor roller 18 in conjunction with an oscillating movement thereof, produced at the compactor roller 18, that is a periodic back-and-forth movement about the axis of rotation D of the compactor roller, optionally also in conjunction with a vibrational movement of the compactor roller, that is, a periodic up and down movement of said roller.

In FIG. 2, the compactor roller 18 is shown in the longitudinal section, that is, cut along the axis of rotation D of the compactor roller. In the exemplary embodiment shown, the compactor roller 18 comprises two roller segments 24, 26, which follow one another along the direction of the axis of rotation D of the compactor roller and are disposed close to one another. Each of the roller segments 24, 26 comprises a casing 28, 30, which provides the outer circumferential surface of the respective roller segment 24, 26, as well as two side pieces 32, 34 or 36, 38, which are connected, for example, on the outside with the casing 28, 30 and are designed, disk-like, for example. In their radially inner region, these side pieces 32, 34, 36, 38 are pivoted by roller bearings 40, 42, 44, 46 on a roller axle 48, which is elongated in the direction of the axis of rotation D of the compactor roller and extends concentrically thereto. In its two axial end regions 50, 52, the roller axle 48 is rigidly carried on the compactor frame 20, for example, at so-called bracket plates 54, 56, so that it cannot be rotated about the axis of rotation D of the compactor roller.

The casing 28 of the roller segment 24 surrounds an interior space 57 of the roller segment 24. Correspondingly, the casing 30 of the roller segment 26 surrounds an interior space 59 of the roller segment 26. This interior space 57 or 59 of the roller segment can be closed off or limited in the axial direction by the respective side pieces 32, 34, 36, 38.

In each case, an electromotive drive 58, 60 is assigned to each of the two roller segments 24, 26. Each of these electromotive drives 58, 60 is configured as an external rotor motor with a stator 62, 64 rigidly carried on the roller axle 48 and an external rotor motor 66, 68 carried on each roller segment 24, 26 or connected non-rotatably therewith. For this purpose, plate-like carriers 70 may be provided in the interior of the respective roller segments 57, 59, which grip radially inward from the roller casing 28, 30 and may be used for fixing the rotors 66, 68.

Electrical supply lines 72 and 74, respectively, can be passed through the axial ends 50, 52 into the interior of the roller axis 48 for supplying the stators 62, 64 with electric energy and can be connected to the stators, more precisely to the stator coils thereof. The electric energy can be generated by the drive assembly provided at the rear section 12. Likewise, coolant supply lines can be passed through the interior of the roller axle 48 and take up coolant for dissipating heat from the interior of the roller segments 24, 26, which has been generated in the area of the electromotive drives, 58, 60, and for conducting heat to and from the stators 62, 64, respectively.

Because of the configuration of the electromotive drives as external rotor motors and with the electromotive drives 58, 60 assigned to the two roller segments 24, 26, a compact, simple to realize construction is attained, which offers especially the advantage that compactor rollers with more than two roller segments can be constructed in the same way. With this construction, it is also possible to assign more than one such electromotive drive to each or at least some of the roller segments.

Due to the electromotive drives 58, 60, an oscillating torque can be generated, that is, a torque changing in amplitude and direction, by means of which the roller segments 24, 26 for carrying out an oscillating movement, that is a periodic back-and-forth rotational movement about the axis D of the compactor roller, are moved with a comparatively small oscillation amplitude, for example, of 2 mm or about 0.2° at an oscillation frequency of up to 50 Hz. Due to such an oscillation movement, which is superimposed on the rolling motion of the of the roller segments 24, 26, an improved compaction result is achieved. Since the electromotive drives, assigned to the various roller segments 24, 26, can be activated independently of one another, it is still possible to ensure that the two roller segments 24, 26 roll with different speeds, that is, rotate with a different RPM about the axis of rotation D of the compactor D, while passing through a curve, nevertheless the oscillating movement of the two roller segments 24, 26, which is superimposed on the rolling motion, is carried out synchronously and in phase.

If the soil compactor 10 is constructed in such a way that the wheels 14, also provided at the rear section 12, are driven by the drive assembly, such as a diesel internal combustion engine, the electromotive drives 58, 60 of the roller segments 24, 26 may be designed or activated in such a way, that they generate substantially only the oscillating torque, since the soil compactor 10 is driven via wheels 14. In particular, in an embodiment of a soil compactor with a compactor roller also at the rear section, it is also possible to use the electromotive drives not only for producing the oscillating torque, but also for generating the drive torque. Here, the electromotive drive is then activated in such a way that an oscillating torque portion for the oscillating torque is superimposed on the comparatively constant drive torque generally required for the propulsion. For example, when activating the electromotive drives, the voltage applied to the electromotive drives for generating the propulsion torque can be superimposed by the oscillating voltage, required for producing the oscillating torque, as a dither signal. For this purpose, an open loop control of the oscillation is feasible just as well as a closed loop control of the oscillation. The oscillating movement can be force-controlled or position-controlled, and the combination of different motion sequences is also possible.

Since the electromotive drives 58, 60 of the roller segments 24, 26 can be activated individually, it is furthermore possible to react very rapidly to changing driving conditions and to adapt the rolling velocity or the propulsion torque as well as the oscillation torque very rapidly and in a large variation range according to changing circumstances by appropriately activating the electromotive drives 58, 60.

The invention claimed is:

1. A soil compactor comprising at least one compactor roller rotatable about an axis of rotation of the roller and a plurality of roller segments following one another along the direction of the axis of rotation of the roller, each roller segment having exclusively assigned therewith an electromotive drive for producing a propulsion drive torque, each electromotive drive for producing a propulsion drive torque being arrange d for additionally producing an oscillating torque applied to the roller segment associated therewith, wherein each electromotive drive is configured as an external rotor motor including a stator and a rotor, which surrounds the stator and is coupled with the assigned roller segment, for a joint rotation about the axis of rotation of the roller, wherein a roller axle, which extends along the axis of rotation of the roller, is provided at a compactor frame such that the roller axle does not rotate about the axis of rotation of the roller, each roller segment being supported so as to rotate about the roller axle, wherein the stator of each external rotor motor is carried on the roller axle.

2. The soil compactor of claim 1, wherein each roller segment is rotatably carried on the roller axle by at least one roller bearing.

3. The soil compactor of claim 1, further comprising electric supply lines and/or supply lines for a cooling medium for each stator.

4. The soil compactor of claim 1, wherein each electromotive drive is disposed in an interior space of the roller segment assigned therewith.

5. The soil compactor of claim 4, wherein each electromotive drive is enclosed in a casing of the roller segment assigned therewith.

6. The soil compactor of claim 1, wherein each electromotive drive is enclosed in a casing of the roller segment assigned therewith.

* * * * *